US006676490B1

(12) United States Patent
Kendhammer

(10) Patent No.: US 6,676,490 B1
(45) Date of Patent: Jan. 13, 2004

(54) STEEL AND STONE BLADE SHARPENING DEVICE

(76) Inventor: Michael A. Kendhammer, 1416 Gillette St., La Crosse, WI (US) 43603

( * ) Notice: Subject to any disclaimer, the term of this patent is extended or adjusted under 35 U.S.C. 154(b) by 0 days.

(21) Appl. No.: 10/336,607

(22) Filed: Jan. 2, 2003

(51) Int. Cl.[7] ..... B24B 7/19
(52) U.S. Cl. ..... 451/45; 451/523; 451/525
(58) Field of Search ..... 451/45, 523, 524, 451/525; 30/123

(56) References Cited

U.S. PATENT DOCUMENTS

| | | | | | |
|---|---|---|---|---|---|
| 2,347,856 | A | * | 5/1944 | Wachter | 451/524 |
| 2,469,586 | A | * | 5/1949 | Wallace | 451/507 |
| 2,484,335 | A | * | 10/1949 | Dingerson | 451/502 |
| 2,624,161 | A | * | 1/1953 | Snell | 451/512 |
| 2,763,968 | A | * | 9/1956 | Burns | 451/524 |
| 3,819,170 | A | | 6/1974 | Longbrake | |
| 3,871,141 | A | * | 3/1975 | Bonapace | 451/524 |
| 3,956,858 | A | * | 5/1976 | Catlin et al. | 451/525 |
| 4,170,343 | A | | 10/1979 | Longbrake | |
| 4,512,112 | A | | 4/1985 | LeVine | |
| 4,528,777 | A | | 7/1985 | Bernstein et al. | |
| 4,558,540 | A | | 12/1985 | Collins | |
| 4,777,770 | A | | 10/1988 | LeVine | |
| 5,163,251 | A | | 11/1992 | Lee | |
| 5,431,068 | A | * | 7/1995 | Alsch | 76/82 |
| 6,398,633 | B1 | | 6/2002 | Lothe | |
| 6,540,582 | B1 | * | 4/2003 | Primos et al. | 446/418 |

FOREIGN PATENT DOCUMENTS

| | | |
|---|---|---|
| GB | 869491 | 5/1961 |

* cited by examiner

*Primary Examiner*—Lee D. Wilson
(74) *Attorney, Agent, or Firm*—M. Paul Hendrickson

(57) ABSTRACT

The present invention provides a blade sharpening and edge uncurling device for sharpening dull blades. The device includes a handle at one end and a conical steel for uncurling edges at an opposite end. A threaded stone retaining shaft bridging between the handle and the steel maintains a circumscribing sleeved stone section in position for sharpening the blades. When the sleeved stone section needs to be replaced, the threaded stone retaining shaft is simply unthreaded to expose the stone for removal and replacement.

6 Claims, 3 Drawing Sheets

STEEL AND STONE BLADE SHARPENING DEVICE

FIELD OF THE INVENTION

The present invention pertains to a blade sharpening device and more particularly to a blade sharpening device equipped with a steel shaping section and a stone sharpening section and its use.

BACKGROUND OF THE INVENTION

Knives such as those used by meat markets and meat processing plants are prone to become dull after frequent use. The knife blade edge will typically curl as well as becoming dull by its use. Butchers use an instrument referred to as "a steel" to uncurl a curled or bent knife edge. The steel is a hardened piece of tapered steel rod which the user deftly slides along the knife's edge on each blade edge in brisk repetitive movements so as to uncurl the bent knife's edge. The knife sharpener will then typically use a wet stone or a grind stone to sharpen the uncurled blade's edge. This is also accomplished by skillfully and repetitively sliding the blade's edge at about a 15 degree angle against the stone along the longitudinally axis of the knife's edge on both edges until it is sharp. The "steel" and wet stone instruments have been used separately as separate tools for ages to uncurl and sharpen the edges of blades.

Numerous patents, both foreign and domestic, have been granted on various knife sharpening devices. Great Britain patent 869491 to Knupp discloses a knife sharpener equipped with two whet steels that intersect at an angle. In order to sharpen the knife blade is placed between the two whet steels and the sharpeners are moved longitudinally to and from along the blade edge until sharpened. In U.S. Pat. No. 3,819,170 to Longbrake, there is disclosed a portable hand-held sharpener with a clamping means. The device is composed of a stone file equipped with clamp means for holding in place any given object to be sharpened. To avoid potential injury to the user, the user makes contact with the object with a separate sharpening member. In another U.S. Pat. No. 4,170,343 to Longbrake, there is disclosed a portable knife sharpener apparatus for holding and maintaining an article during sharpening. The invention embodies two parts on of which is the hand-held clamping means (two clamp members) for holding the knife to be sharpened and a rectangular sharpening stone. In U.S. Pat. No. 4,512,112 to LeVine, there is disclosed knife sharpener clamp equipped with a guide member of the same width as the clamp member, openings to receive a guide rod of the sharpening stone hold, a guide rod of a sharpener stone holder which carries a sharpening stone, and receiving openings in the clamp to facilitate the user's grasp. In U.S. Pat. No. 4,528,777 to Bernstein, et al, there is disclosed a knife sharpener device that has a grinding element which can be used on a knife edge in a spiral path through 180 degree traverse and reverse actions. The Bernstein, et al, patent includes a stationary mounting plate having a groove for receiving and retaining a blade to be sharpened, and an elongated knife blade positioned in the groove of a mounting plate, a U-shaped bracket pivotally mounted on one side of the plate beneath and to one side of the groove, and a means for maintaining constant contact between the grinding element and the edge of said knife. In U.S. Pat. No. 4,558,540 to Collins, there is disclosed a portable hand-held knife sharpener that has a telescoping sharpening element that is housed in a tray and which has a bolt-action button device for extending and retracting the sharpening element. The sharpening element or stone is composed of an aluminum composite. In U.S. Pat. No. 4,777,770 to LeVine, there is disclosed an elongated sharpening stone with a design for improved sharpening by use of a carefully spaced finger grip for protection wherein the user can slide the sharpener in a sweeping motion across the knife. In U.S. Pat. No. 5,163,251 to Lee, there is disclosed ahand-held knife sharpener wherein the user positions the blade to be sharpened between an area as depicted therein. The Lee patent design reportedly allows safe usage when the knife is being sharpened as it faces downward in relation to the user. U.S. Pat. No. 6,398,633 to Lothe discloses a hand held sharpener for sharpening the cutting edge of a blade of a cutting tool comprising a housing, a mounting surface, a sharpener with three stones mounted against the mounting surface to form the sharpener having a center stone, a left stone and a right stone.

There exists a need for a single tool which may be effectively utilized to both uncurl and sharpen a blade's edge.

SUMMARY OF THE INVENTION

The present invention provides a blade edge uncurling steel (referred in the trade as a "steel") and blade edge sharpening device.

The tool 1 includes a handle 3, an accessible stone retaining shaft 4 supportive of a removable sleeved stone sharpening section 5 attached to the handle 3 at one shaft end and connected to a coned-shaped steel shaping section 2 for uncurling a blade edge at an opposite end. The stone retaining shaft 4 supports a circumscribing hollow cylindrical sleeved stone section 5 snuggly nestled between the handle 3 and the steel shaping section 2. The stone retaining shaft 4 is designed so as to permit access to the sleeved stone sharpening section 5 and allow the stone to be removed and replaced with another sleeved stone section 5 when necessary. The steel retaining shaft 4 needs to be accessible for sleeve 5 replacement and this may be separable from either steel shaping section 2 or handle 3 so access may be readily obtained to the steel retaining shaft 4 and sleeved stone section 5. The uncurling and sharpening device 1 is especially adapted so as to permit the stone sharpening section 2 to be removed or replaced from the stone retaining shaft 4 mount. This may be effectively accomplished by allowing the accessibility to the stone retaining shaft 4 by separating it from the handle or from the steel section so as to provide open access to the stone sharpening section 5.

DETAILED DESCRIPTION OF THE INVENTION

Figure 1:
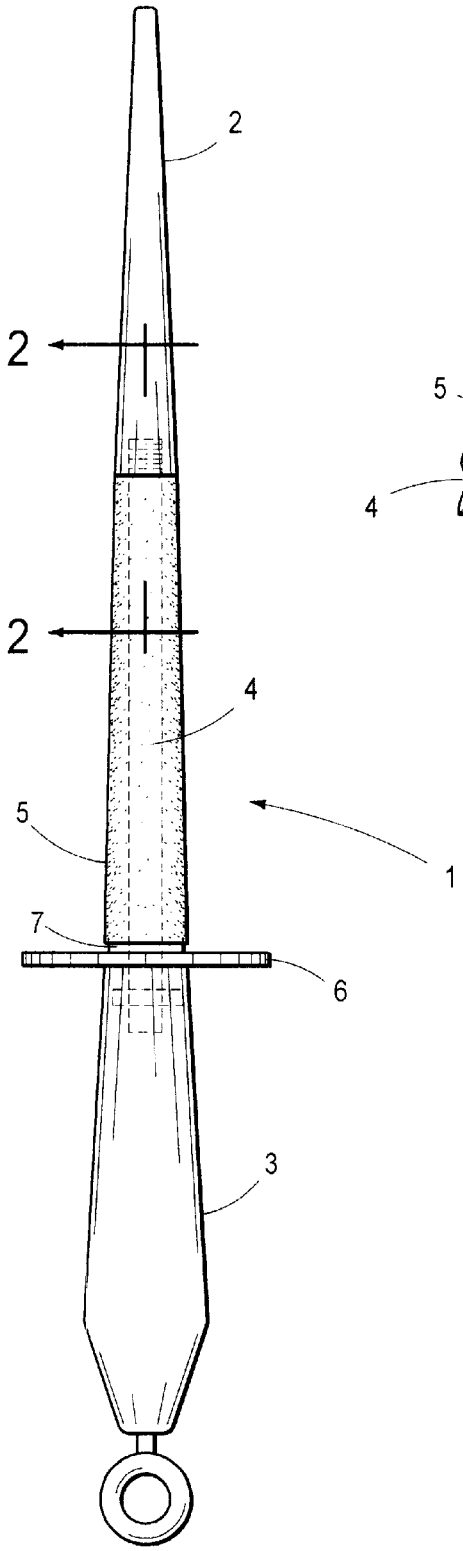
FIG. 1 is a side view of the blade uncurling and sharpening device of this invention.

Pursuant to the present invention, there is provided an uncurling and blade sharpening device 1 which allows a blade sharpener to use a single device for the uncurling and sharpening of blade edges E. With particular reference to the Figures, the uncurling and sharpening device 1 includes a steel shaping section 2 for uncurling bent blade edges E and a removable and replaceable sleeved stone sharpening section 5 for sharpening the uncurled blade edges E, a handle 3 for holding the tool 1 in a blade edge engaging position and a stone retaining shaft 4 for retaining the stone sharpening section 5 in position for sharpening a blade edge E. The stone sharpening section 5 is depicted as a replaceable elongated annular sleeved sharpening stone 5 retained in an axially aligned sharpening position between the handle 3 and the steel shaping section 2 by the stone retaining shaft 4.

The device is especially designed so as to permit periodical replacement of the stone sharpening section 5 with another stone sharpening section 5. This may arise when the stone sharpening section 5 has become excessively worn through use or it may just be desirable to switch to multiple stone sharpening sections 5 for the sharpening of different blades or for use in different stages in the blade sharpening process.

Figure 2:
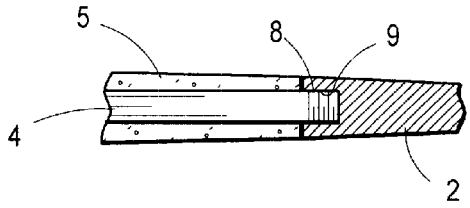
FIG. 2 depicts a partial cross-sectional view of the device shown in FIG. 1 taken along line 2—2 of FIG. 1.
Figures 3, 3A, 3B:
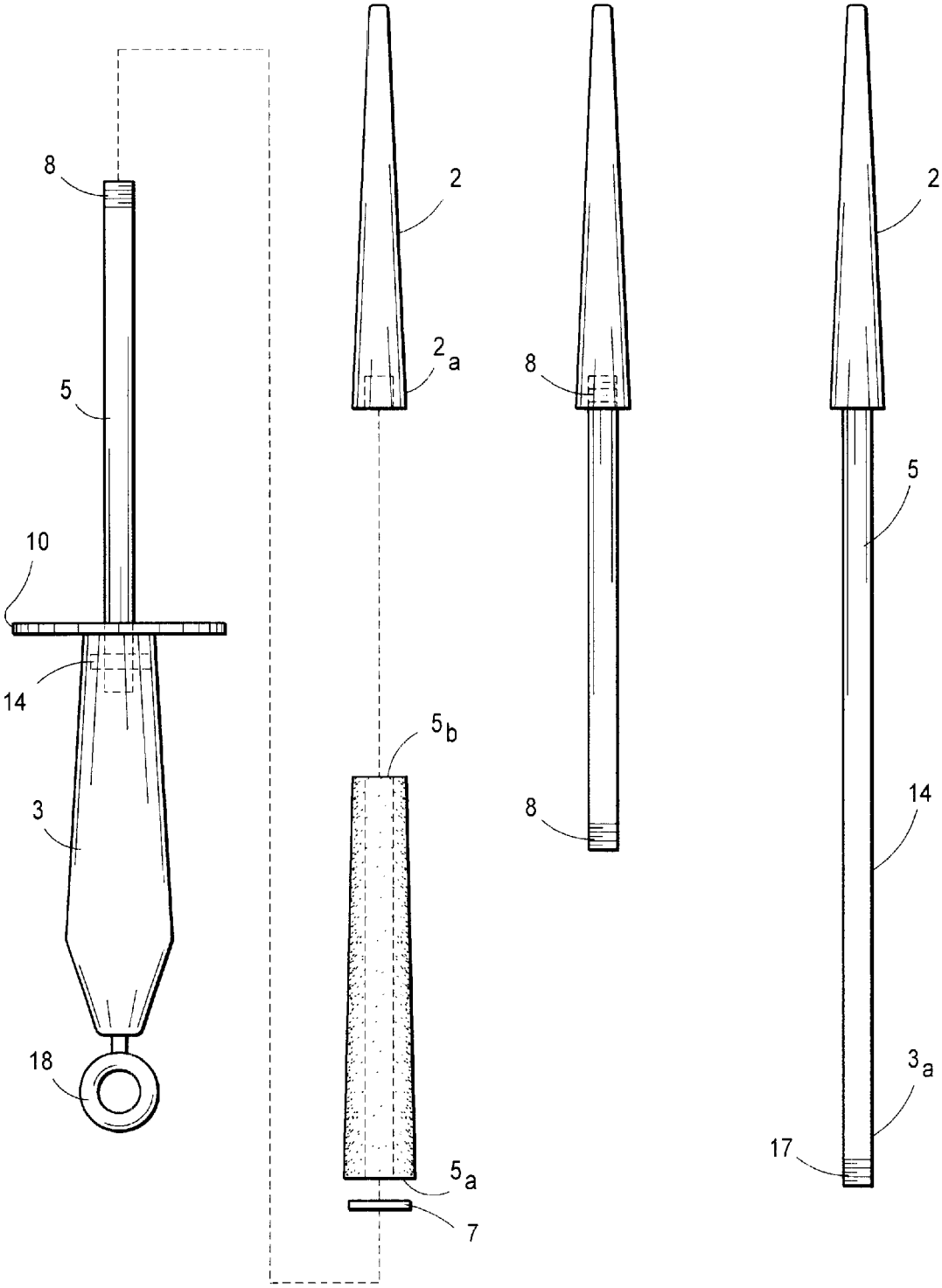
FIG. 3 is an exploded side view of the device depicted in FIG. 1 showing a replaceable sharpening stone sleeved section separated from a stone retaining shaft.
FIG. 3A depicts another embodiment of the stone retaining shaft of the device shown in FIG. 3.
FIG. 3B is a further embodiment of the stone retaining shaft shown in FIGS. 3.
Figure 4:
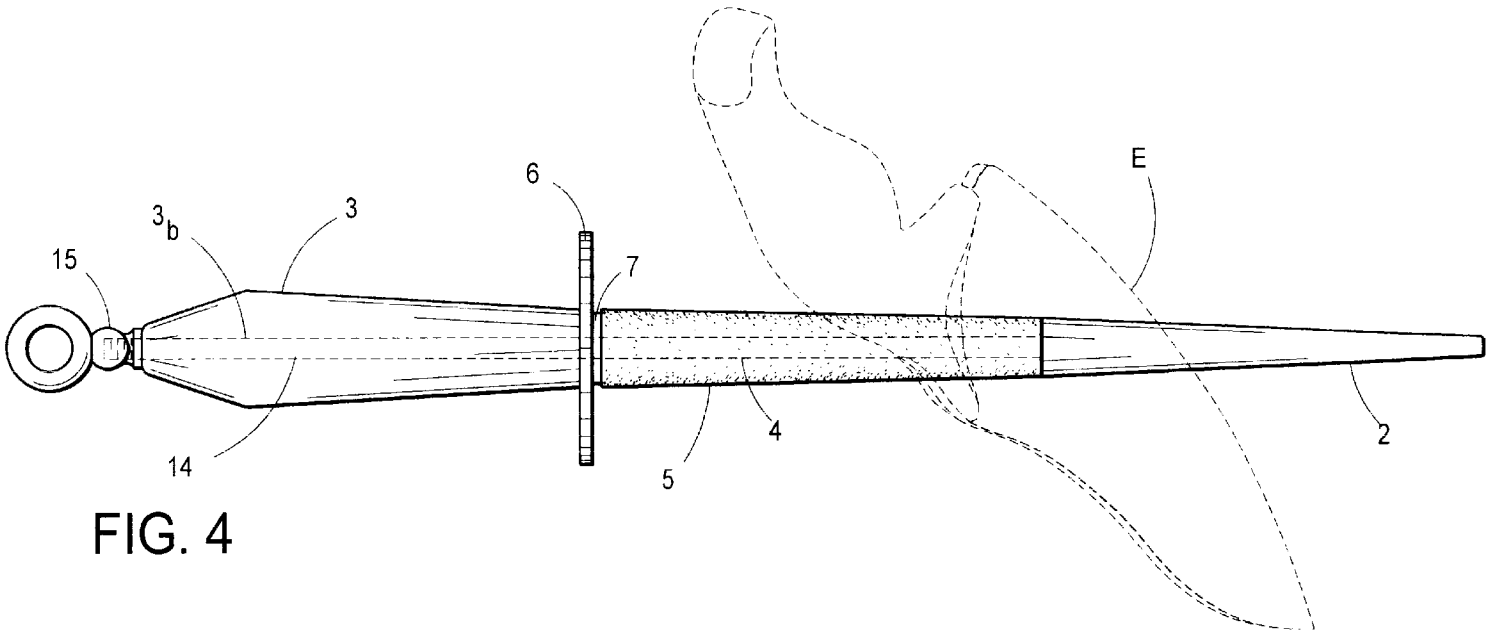
FIG. 4 is a side view of the device shown in FIG. 1 equipped with the stone retaining shaft of FIG. 3B.
Figure 5:
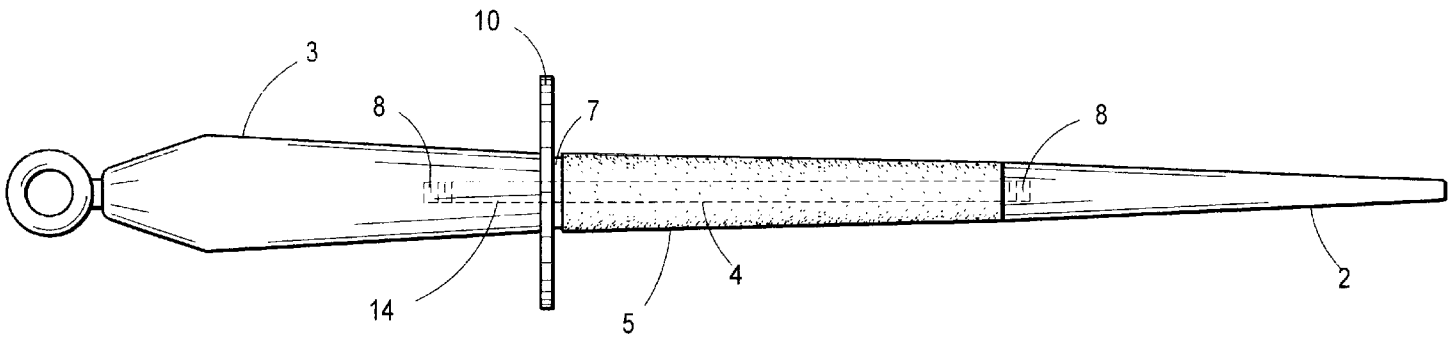
FIG. 5 is a side view of the device shown in FIG. 1 equipped with the stone retaining shaft of FIG. 3A.

The broken lines in the Figures depict a number of modifications to the stone retaining shaft 4 so as to permit access and removability of the sleeved stone sharpening section 5 from the device 1. FIG. 3 depicts the stone retaining shaft 5 anchored or secured to the handle 3 and threaded at the opposite shaft with threads 8 for threading onto the mating female threads 9 at a support end 2*a* of the steel shaping section 2. Exposure of the sleeved sharpening section 5 may be accomplished simply by unthreading the stone retaining shaft 4 from the steel shaping section 2 so as to allow removal of the sleeved sharpening section 5 as illustrated in FIG. 3. FIGS. 3B and 4 illustrate other embodiments of the device shown in FIGS. 1–3 depicting the stone retaining shaft 4 as an integral milled part of steel section 2 which extends outwardly sufficiently so as to not only retain the sleeved stone section 5 but also extends and exit through a lengthwise bore 3*b* in handle 3 with threaded hanger nut 15 being threaded via a shaft handle support section 3*a* onto the shaft threads 17 as depicted by FIGS. 3B and 4. In FIGS. 3A and 5, the stone retaining shaft 4 is threaded at both shaft ends with threads 8 which are respectively adapted to thread into mating female threads disposed in handle 3 and the female threads 9 of steel section 3 as may be observed from FIG. 2.

In all of the depicted embodiments of the invention as shown in the Figures, the stone sharpening section 5 is protectively disposed between the handle 3 and the steel shaping section 2 which in case of inadvertent impacting of device 1 against other objects will serve to absorb the impacting forces and protect the sleeved sharpening stone section 4 against damage or breakage. Protection of stone section 5 against breakage may be accomplished by insulating at least one sleeved stone end (5*a* and 5*b*) with a shock insulating insert and such as a leather, felt, spring, rubber, etc, insert. A plastic or rubber washer at the handle end (5*a*) is particularly effective for this purpose.

The stone retaining shaft 4 serves to maintain the stone sharpening section 5 in a workable position for sharpening a blade's edge E. Modern day sharpening stones are manufactured by molding techniques which allow the stone to be configured in various shapes and designs as well as sharpening grit. This allows stone section 5 to be made in a desired sleeve form and size for use herein. As shown in the figures, the sharpening stone section 5 comprises a cylindrical shaped sleeved section 11 having a longitudinally extending bore 13 of an internal diameter so to as internally mate onto the stone retaining shaft 4. The stone sharpening section 5 is preferably of a contour so as to smoothly contour onto the abutting edge of the steel shaping section 2 as shown in FIGS. 1, 4, & 5. The molded cylindrical sleeved section 15 may be fabricated with a wide variety of conventional sharpening grits ranging from course to medium to a fine grit with the latter being preferred for most knife sharpening operations.

The invention utilizes a unique hollow cylindrical sleeved stone section 5 sized so as to slide onto and fit snuggly onto the stone retaining shaft 4 between the handle 3 and the steel shaping section 2. The sleeved sharpening stone 5 is of length so that when it is inserted upon the stone retaining shaft 4 and drawn tightly between the handle 3 and the steel shaping section 2, the sleeved stone section 5 will tightly fit thereupon. The use of shock absorbing insulator 7 such as a plastic or rubber washer allows the sleeved stone section 5 to be tightly biased between the shaping section 2 and handle 3 when tightly drawn together by the threading of the stone retaining shaft 4 therebetween. This is necessary not only to protect the shaping stone 5 from braking but also to maintain the stone 5 in a fixed position for effective sharpening.

The outer surface of the sleeved stone section 5 and steel shaping section 2 are of a uniform contour so as to permit a blade edge E to be sharpened thereupon to smoothly traverse therebetween. The present invention allows the user to use the single instrument for both the uncurling and sharpening of the knife's edge E. The two steps are typically conducted in sequence by initially contacting the knife's edge E against the steel shaping section 2 of the tool 1 as to uncurl the knife's edge E and then by repositioning the tool 1 so that the sleeved stone section 5 sequentially contacts both blade edges E briskly in a back and forth motion until sharpened. The sleeved stone sharpening section 5 may range from an ultra fine stone grit to a medium stone grit to a very course stone grit as desired. The positioning of the sleeved stone sharpening section 5 by its protective placement between the handle 3 and the steel shaping section 2 serves to protect the sleeved stone sharpening section 5 from inadvertent damage such as by dropping.

The preferred embodiment of providing access to the replaceable stone sharpening section 5 is illustrated by FIGS. 3B and 4 in which the steel shaping section 2 and the stone retaining shaft 4 are an integral unit milled from a common milling shaft with a cone shaped portion serving as the steel shaping section 2 and a slightly smaller diameter shaft portion serving both as the stone retaining shaft section 4 and as a handle maintaining shaft section 14. As may be observed from FIG. 4, the handle 3 includes a handle retaining bore 15 for receiving the handle maintaining section 14. The proximate end of the handle maintaining section 14 is threaded with threads 17 for threading of securing nut 15 equipped with hanger 18 for hanging the device 1. The securing nut 15 biases the steel section 2, the stone sharpening section 5 and protective rubber washer 7 firmly against blade guard 6 and handle 3 when securing nut 15 is threaded tightly onto threads 17. When it is desired to replace the stone sleeve sharpening section 5, securing nut 15 is merely unthreaded from threads 17 allowing the handle 3, blade edge protector 6, and washer 7 to be removed from core portion 14 and exposing the stone sharpening sleeved section 5 which may be removed and replaced with another sleeved section 5.

The uncurling and sharpening device 1 as shown in FIGS. 1, 3, 4 and 5 includes a blade guard 6 for protecting the user and shock absorbing (e.g. rubber) washer 7 which serves to protectively insulate the sleeved stone sharpening section 5 against accidental breakage. Since the sleeved stone sharpening section 5 will become worn and require replacement, the uncurling steel section 2 includes as illustrated in FIG. 1 internally disposed female threads 9 for threading onto the stone maintaining shaft threads 8. When it is necessary to replace sleeved section 5, the uncurling steel section 2 is unthread from connecting shaft 4 to provide access to sleeve 5. The stone maintaining shaft 4 may be threaded onto handle 3 or to both the handle 3 and steel section 2.

What is claimed is:

1. A blade sharpening device which allows a blade sharpener to use a single instrument to uncurl and sharpen blade edges, said device comprising a stone retaining shaft having a handle attached at one shaft end and a steel shaping section at an opposite shaft end, with said stone retaining shaft being separable from either said handle or said steel section, a replaceable sleeved sharpening stone retained in a sharpening position supported by said shaft and biased between said handle and said steel section, with said steel section and said sleeve having an outer contour so as to permit the blade edges to be smoothly drawn thereupon.

2. The device according to claim 1 wherein the handle includes an internally dispose shaft receiving bore, the stone maintaining shaft is an integral part of the steel shaping section and of a sufficient shaft length to extend lengthwise through the stone sleeved sharpening section and a shaft receiving bore disposed lengthwise within said handle, with said stone maintaining shaft having nut engaging threads protruding outwardly from said handle and a threaded nut threaded onto said nut engaging threads so as to biasingly force said handle firmly onto said sleeved sharpening stone.

3. The device wherein a shock absorbing washer is disposed between said handle and said replaceable sleeved sharpening stone.

4. A method of uncurling and sharpening blade edges with an instrument comprised of a stone supporting shaft having a handle attached at one shaft end, an uncurling steel tip at an opposite shaft end, a replaceable stone sharpening sleeve sleeved onto said stone supporting shaft and biased between said handle and said steel tip, with the uncurling steel tip and said sleeve of said instrument having an outer surface contour so as to permit the blade edges to be smoothly drawn thereupon, said method comprising:

a) uncurling a blade edge by briskly contacting one side of a blade edge and then by contacting another side of the blade edge upon said uncurling steel tip to provide an uncurled blade edge, and b) sharpening the uncurled blade edge upon said stone sharpening sleeve.

5. The method according to claim 4 wherein the instrument includes a stone sharpening sleeve replacement and method comprises the additional step of:

a) detaching the stone supporting shaft from said handle so as to provide access to the replaceable stone sharpening sleeve, b) replacing the replaceable stone sharpening sleeve upon said stone supporting shaft with said stone sharpening sleeve replacement, c) biasing the stone sharpening sleeve between said uncurling steel tip and said handle, and d) continuing the uncurling and the sharpening of a curled and unsharpened blade edge with said instrument equipped with said stone sharpening replacement.

6. The method according to claim 5 wherein the instrument includes a pliable spacer disposed between the handle and the steel tip, and the method includes the biasing of the stone sharpening sleeve between said uncurling tip and said handle.

* * * * *